US005434377A

United States Patent [19]

Martin et al.

[11] Patent Number: 5,434,377

[45] Date of Patent: Jul. 18, 1995

[54] PUSHBUTTTON ELECTRICAL SWITCH ASSEMBLY

[75] Inventors: Adolf H. Martin, Glenview; James L. Murphy, Streamwood, both of Ill.

[73] Assignee: Invento AG, Hergiswil NW, Switzerland

[21] Appl. No.: 169,042

[22] Filed: Dec. 20, 1993

[51] Int. Cl.[6] ..... H01H 9/18

[52] U.S. Cl. ..... 200/314; 200/573

[58] Field of Search ..... 200/313, 314, 573, 574, 200/293, 295, 296, 292

[56] References Cited

U.S. PATENT DOCUMENTS

| | | | |
|---|---|---|---|
| 3,639,745 | 2/1972 | Shiki | 200/314 X |
| 4,301,344 | 11/1981 | Sakakino et al. | 200/314 |
| 4,332,990 | 6/1982 | Stevens | 200/314 |
| 4,389,551 | 6/1983 | Deibele et al. | 200/573 X |
| 4,504,713 | 3/1985 | Hennessey . | |
| 4,683,359 | 7/1987 | Wojtanek | 200/314 |
| 4,778,952 | 10/1988 | Watkins et al. | 200/714 X |
| 4,956,528 | 9/1990 | Janniere et al. | 200/314 |
| 5,201,408 | 4/1993 | Torma et al. | 200/294 |
| 5,280,148 | 1/1994 | Cummins | 200/314 X |

FOREIGN PATENT DOCUMENTS

| | | |
|---|---|---|
| 0446487 | 9/1991 | European Pat. Off. . |
| 0548556 | 6/1993 | European Pat. Off. . |
| 2557352 | 6/1985 | France . |
| 3440442 | 5/1986 | Germany . |
| 2242572 | 10/1991 | United Kingdom . |

OTHER PUBLICATIONS

European Search Report and Annex.

*Primary Examiner*—Renee S. Luebke

*Attorney, Agent, or Firm*—Sandler, Greenblum & Bernstein

[57] ABSTRACT

A pushbutton electrical switch assembly, having a particularly low profile and having uniform illumination, includes a lighting system within the housing of the pushbutton electrical switch assembly, the lighting system having four light diodes that are squarely arranged upon a printed circuit. Switching members in the form of microswitches together with the lighting system are arranged adjacent to each other and transversely to the direction of displacement of a pushbutton that is slidably arranged within the housing. The microswitches take a position in which the direction of movement of the actuation member and the direction of movement of the microswitches are perpendicular to each other. The printed circuit and the microswitches are fitted in a sandwich-type manner between flanges of lower and upper housing portions, with the housing portions being connected without screws.

17 Claims, 3 Drawing Sheets

PUSHBUTTTON ELECTRICAL SWITCH ASSEMBLY

BACKGROUND OF THE INVENTION

1. Field of the Invention

This invention pertains to a pushbutton electrical switch assembly having a multipart housing that includes a slidably retained pushbutton, a lighting system, an actuation member and switching members, in the form of microswitches, wherein via the actuation of the pushbutton, the actuation member is displaced against a resilient force and acts upon the switching members.

2. Discussion of the Background of the Invention and Material Information

U.S. Pat. No. 4,504,713 discloses a modularly built pushbutton electrical switch assembly having an optical display that signals the switching state. The pushbutton electrical switch assembly is comprised of a housing module, a housing cover module, a contact carrier module and a lamp module. The lamp module, comprised of a lamp holder and a lamp, is contained in the housing module. The contact carrier module is slidably retained in the housing module, wherein the housing module utilizes fixed contacts whereas the contact carrier module utilizes resilient contacts. A pushbutton, slidably retained in the housing cover module, upon actuation, moves the contact carrier module against a resilient force up to a stop, whereby contact is established between the fixed and the resilient contacts. The pushbutton is comprised of translucent material so that the illumination of the lamp, which extends through an aperture in the contact carrier module, can be observed at contact making. The housing module and the housing cover module include superimposed bosses, including apertures, for receiving threaded bolts, the latter being welded to an indicator board, for example for elevators, with these bolts serving for the attachment of the pushbutton switch.

A disadvantage of this pushbutton electrical switch assembly resides in the relatively high or great installation depth, particularly due to the lamp module, so that this switch cannot be utilized in those installations that only have a small space between the indicator board and the wall or another boundary limit. The high depth is, on one side, due to the elongated form of the filament bulbs which, moreover, only have a short service life and are sensitive to vibrations so that they must be replaced quite often, which is both time-consuming and expensive. On the other hand, the installation depth is also necessitated by the relatively complicated and expensively assembled lamp holder which includes handles that extend out of the switch housing during bulb changing.

European Patent Publication EP-A-0 548 556 discloses a command and indicator apparatus that utilizes a multipart pushbutton having a displaceable lighting system. The latter is comprised of light-emitting semiconductors, arranged on a first printed circuit board, whose light is channeled, via an annular light pipe or cable, to the underside of a glass that forms the front side of the pushbutton. The light pipe runs along the edge of the glass, with the uncovered area of the glass being covered with an opaque layer, so that, during actuation of the pushbutton, a light ring appears as an acknowledgement signal. The pushbutton is slidably retained in a spherical indentation which is connected with a switch carrier via a snap connection. A second printed circuit board is attached at the lower end of the switch carrier, with a microswitch being carried by the circuit board. The actuation of a pot-shaped plunger of the pushbutton actuates the switching element of the microswitch.

The microswitch is arranged in such a manner that the switching element is displaced in the direction of movement of the pushbutton. Moreover, since the lighting apparatus, the plunger and the microswitch are located behind each other in the direction of movement of the pushbutton, a relatively great installation depth results therefrom. Additional disadvantages are present in that two printed circuit boards are required which have to be connected with flexible multi-conductor leads and plug contacts whereby the assembly becomes more complicated and more expensive. In addition, via the use of the previously described, as well as with a point-shaped light source variation of the lighting system, no uniform full illumination of the pushbutton can be achieved.

SUMMARY OF THE INVENTION

It is an object of this invention to provide a pushbutton electrical switch assembly of the initially noted type which does not suffer from the recited disadvantages and which particularly has a lower profile and which permits uniform full illumination of the pushbutton.

This object is achieved in a pushbutton electrical switch assembly comprising a multipart housing including lower and upper housing portions, with the housing including a slidably retained pushbutton; a lighting system; an actuation member acting in one direction; biasing means acting in a direction opposite to the actuation member; switching members, including switching elements, wherein, via the actuation of the pushbutton, the actuation member is displaced against the biasing means and acts upon the switching members; the lighting system includes four light diodes, the light diodes are arranged squarely on a printed circuit; the switching members and the lighting system are arranged adjacent to each other and transversely to the direction of displacement of the pushbutton; the switching members are mounted in a position in which the directions of movement of the actuation member and the direction of movement of the switching elements of the microswitches are perpendicular to each other; the printed circuit and the switching members are fitted, in a sandwich-type manner, between flanges of the lower and upper housing portions; and the lower and upper housing portions are interconnected without screws.

The lower and upper housing portions are generally square in shape and of the same size; each of the housing portions have two bosses which in turn have apertures; the bosses are arranged at diagonally opposed corners of the housing portions and are superimposed over one another; each boss of the lower housing portion includes a pipe-shaped projection, with the projection having a bevelled shoulder and slots at a distal end thereof; the apertures of the bosses of the upper housing portion are adapted to receive the pipe-shaped projections and include a counterbore at each upper end thereof; and the bevelled shoulders are adapted to snap-fit into the counterbores during an assembly of the lower and upper housing portions.

Preferably, the actuation member comprises a substantially square plate, the plate being supported, relative to a bottom of the lower housing portion, by the biasing means, with the actuation member including switching cams, with the switching cams actuating the switching members.

In the pushbutton electrical switch assembly according to the present invention, the actuation member includes hook members, the hook members, via the action of the biasing means, abutting projections on the upper housing portion, thereby determining a boundary position of the actuation member. The actuation member further includes slits, the slits being open on one side, with the slits serving for the reception of foot portions of the pushbutton.

Preferably, the light generated by the light diodes has a cone of about 90 degrees; and the printed circuit includes a bridge rectifier for converting AC to DC current to the light diodes.

Preferably, the switching members are microswitches; and the biasing means comprises four compression springs, with the compression springs being arranged at the corners of the lower and upper housing portions.

The advantages achieved by this invention reside in that by means of the particular shaping of the lighting system and its position, relative to the microswitches, achieve a low switch assembly height, so that the switch can also be utilized in those installations that have only little space behind the indicator board. Additional advantages are realized from its insensitivity to vibration and the long working or service life of the light diodes, which generally never need to be replaced so that maintenance costs are reduced. A further reduction in assembly height is achieved in that the microswitches are so arranged as to have their smallest dimension in the direction of movement of the pushbutton. In addition, via the reorientation of the switching movement, damage to the microswitches, caused by strong impacts upon the pushbuttons, are avoided. Through the use of a square arrangement of the light diodes, good illumination is achieved in round as well as square pushbuttons. The snap connection between the lower and upper housing portions allows that the microswitches, the printed circuit and the actuation member are preassembled, without screws, into a module that can be stored until final assembly. The insertion of the feet of the pushbutton into slots in the actuation member increases the rigidity thereof and assures the satisfactory displacement thereof.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 2:
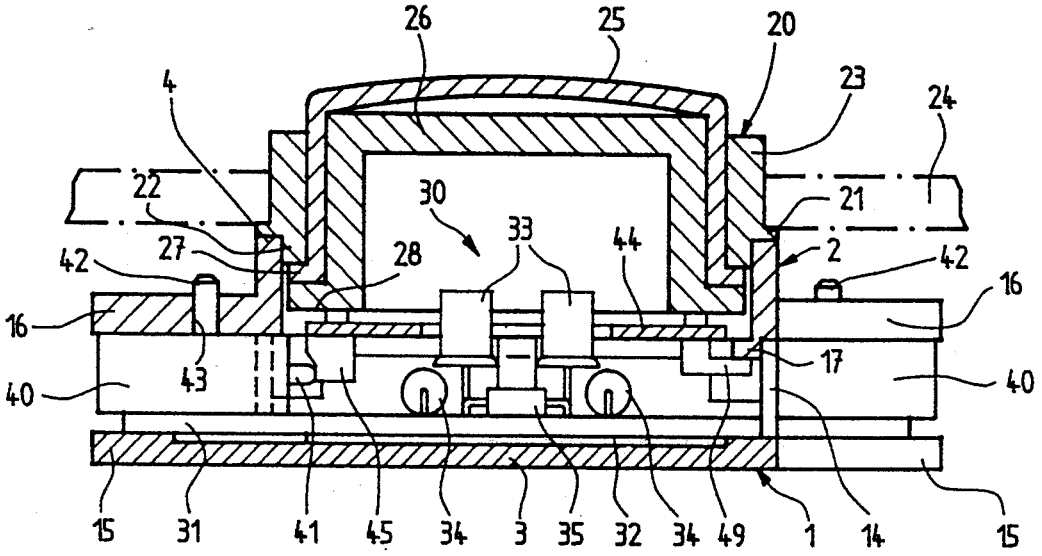
FIG. 2 is a cross section taken along line II—II of FIG. 1.
Figure 1:
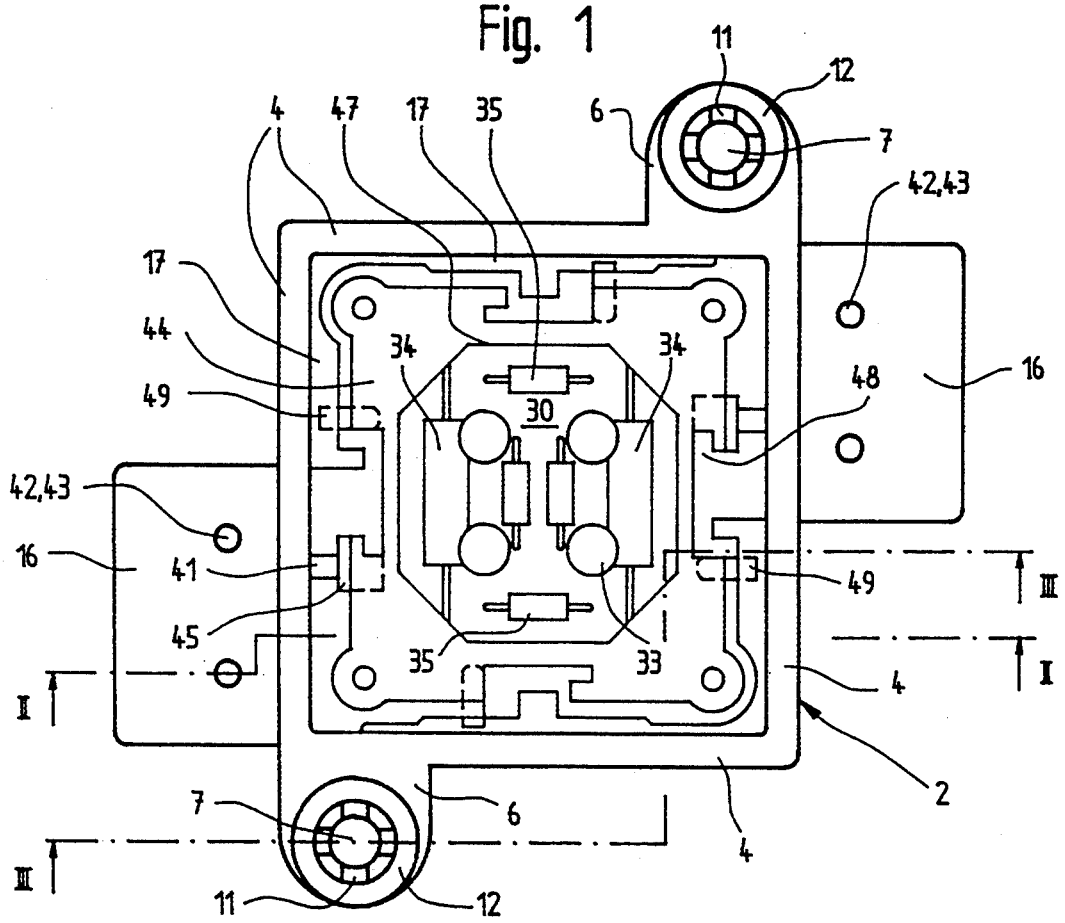
FIG. 1 is a large scale top plan view of the pushbutton electrical switch assembly of this invention with its housing cover removed.
Figure 3:
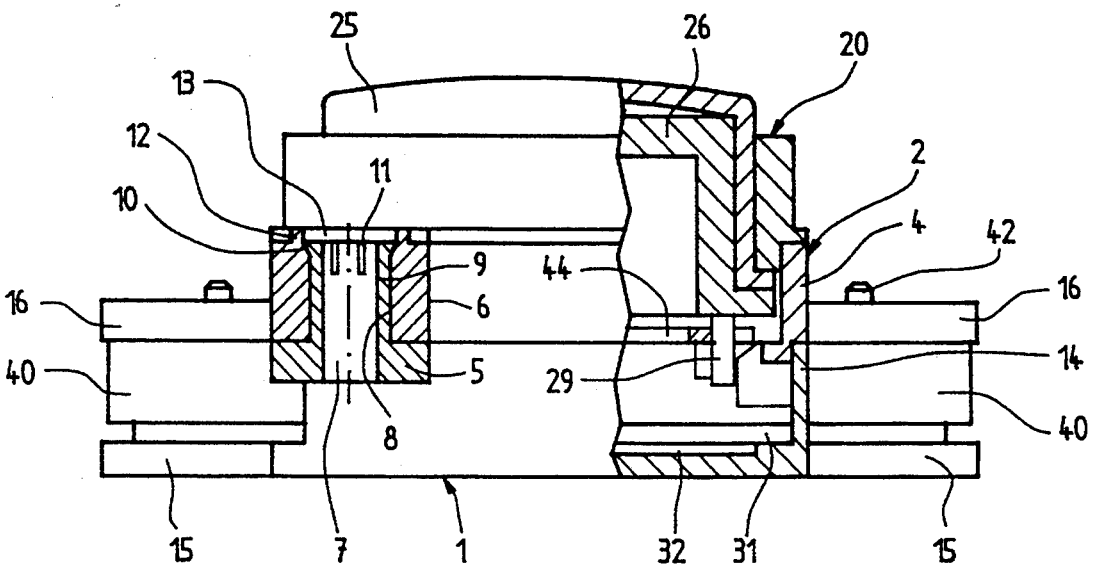
FIG. 3 is a partial cross section taken along line III—III of FIG. 1.
Figure 4:
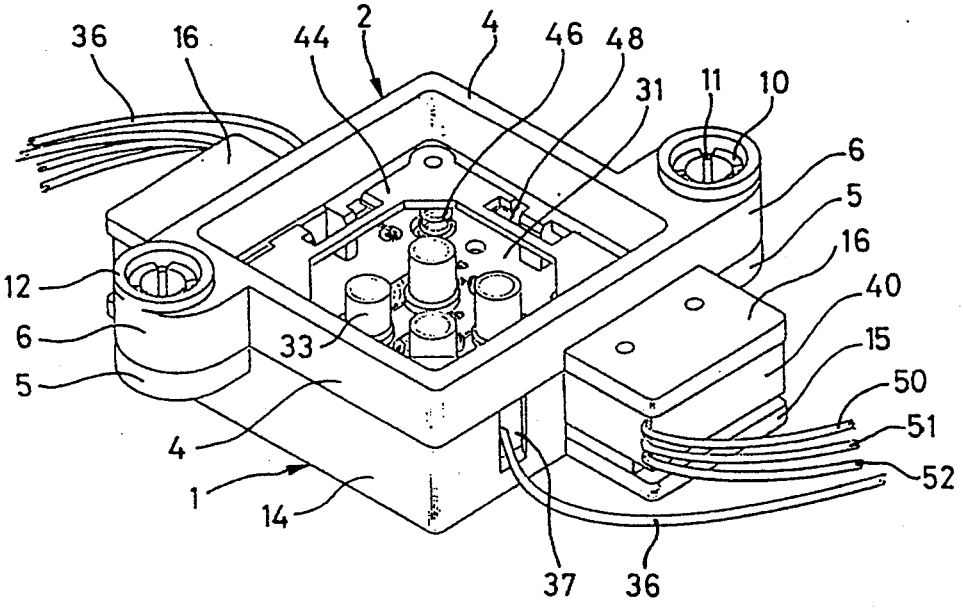
FIG. 4 is a perspective plan view of the pushbutton electrical switch assembly of FIG. 1.

Numeral 1 in FIGS. 2–4, represents a lower housing portion, while numeral 2 represents an upper housing portion, both of which are of quadrate form as well as of the same size. Lower housing portion 1 is provided with a bottom or base portion 3 while upper housing portion 2 is merely formed by sidewalls 4. Lower and upper housing portions 1 and 2 include bosses 5, 6, respectively, which in turn include respective apertures 7, 8, with bosses 5, 6 being arranged on diagonally opposed corners and being superimposed over one another. Bosses 5 of lower housing portion 1 include pipe-shaped projections 9 that have bevelled shoulders 10 and slots 11 at their distal ends. Apertures 8 of bosses 6 of upper housing portion 2 are adapted to receive pipe-shaped projections 9. Bosses 6 include raised eyelets 12 at their upper ends and apertures 8 include a counterbore 13 into which bevelled shoulder 10 can snap-fit during the assembly of the lower and upper housing portions 1, 2. Two parallel-extending sidewalls 14 and 4 of housing lower and upper portions 1, 2, respectively, each include two respective overlapping flanges 15, 16, which are displaced towards each other in the direction of the sidewalls. Flange 15 of lower housing portion 1 is in the same plane as bottom 3 of housing lower portion 1, while sidewalls 14 of lower housing portion 1 are interrupted in the regions of flanges 15. Flanges 16 of upper housing portion 2 are arranged at the lower edges of sidewalls 4, which abut upon the upper edges of sidewalls 14 of lower housing portion 1. In addition, the lower edges of sidewalls 14 of upper housing portion 2 include inwardly directed projections 17.

A housing cover 20 is located upon sidewalls 4 of upper housing portion 2 and includes an edge 21 having the same thickness as eyelets 12. Housing cover 20 includes a quadrate form or square projection 22 on one side thereof, with projection 22 being retained in upper housing portion 2. The other side of housing cover 20 includes an annular projection 23, which for example, extends into a circular cutout of an indicator board 24 on which the switch is to be mounted. Numeral 25 designates a lens cap which is pushed over a pushbutton 26. Lens cap 25, together with pushbutton 26, are slidably retained in housing cover 20. Lens cap 25 and pushbutton 26 include overlapping edges 27 and 28, wherein edge 27 of lens cap 25, at an end position of pushbutton 26, abuts projection 22 of housing cover 20.

As seen in FIG. 3, edge 28 of pushbutton 26 is provided with four downwardly extending feet 29.

A lighting system 30 includes a printed circuit 31 which lies upon bottom 3 and flanges 15 of lower housing portion 1. Bottom 3 includes recesses 32 and non-illustrated openings for ventilation purposes and the reception of soldered joints of printed circuit 31 so as to provide a satisfactory support therefore. Printed circuit 31 includes four light-emitting or light diodes 33 which are arranged in a square manner. The preferably utilized light diodes 33 generate light having a cone of about 90 degrees so that they can be placed closer to the inner side of pushbutton 26 than conventional light diodes which have a light cone of 60 degrees. Thereby, the installation depth of the switches can be reduced without additionally heating pushbutton 26. In addition, in combination with the square or quadrate form placement of the four light diodes 33, uniform illumination is achieved in round as well as square pushbuttons.

In order to obtain as much white light as possible, light diodes with yellow light and pushbuttons of white translucent plastic material are utilized, with lens cap 25, which is pushed over pushbutton 26, being constructed of transparent plastic material. On printed circuit 31, for the supply of current for light diodes 33, instead of using a single externally mounted resistor of greater capacity, two smaller resistors of smaller diameter and smaller capacity are utilized. Through this utilization, the heat losses during operation are better distributed and the switch installation depth is further reduced. Numeral 35 represents the diodes of a bridge rectifier which are also arranged on printed circuit 31. The bridge rectifier, in order to provided direct current supply for light diodes 33, is provide with alternating current via leads 36 which extend through slits 37 in lower housing portion 1.

Two microswitches 40 are arranged upon printed circuit 31 laterally from lighting system 30 so that the direction of movement of pushbutton 26 and the direction of movement of switching elements 41 of microswitches 40 are perpendicular to each other. Microswitches 40 and printed circuit 31 are fitted, in a sandwich-type manner, between flanges 15, 16 of lower and upper housing portions 1, 2, wherein microswitches 40 assume a position wherein their smallest dimension lies in the direction of movement of pushbutton 26. In order to avoid movement or displacement of microswitches 40, they are fixed, by means of pins 42 in openings 43 in flanges 15, 16 and in printed circuit 31.

Switching elements 41 of microswitches 40 are actuated via switching cams 45 of an actuating member 44 in the form of an essentially quadrate form plate. Actuation member 44 is supported, in relation to bottom 3 of lower housing portion 1, by means of four compression springs 46 that are arranged at the corners of lower and upper housing portions 1, 2, respectively, whereby compression springs 46 are retained via non-illustrated attachments on lower housing portion 1. Switching element 44 includes a central opening 47, with light diodes 33 extending therethrough. The side edges of switching element 44 include slots 48 which are open on one of their long sides and serve for the reception of feet 29 of pushbutton 26. Located next to slits 48, are hooks 49, which, under the influence of compression springs 46, abut projections 17 of upper housing portion 2, thereby defining a boundary position for actuation member 44. The connections of microswitch 40 are connected with three leads 50, 51 and 52.

Pushbutton electrical switch assemblies of the previously described type are, for example, utilized in elevators, where they are used in the cars as car call transmitters, or utilized at the floors as floor call transmitters. Here, the switches are attached at an indicator board 24 (FIG. 2), with threaded bolts, welded to the indicator boards, extending from apertures 7 of bosses 5.

Figure 5:
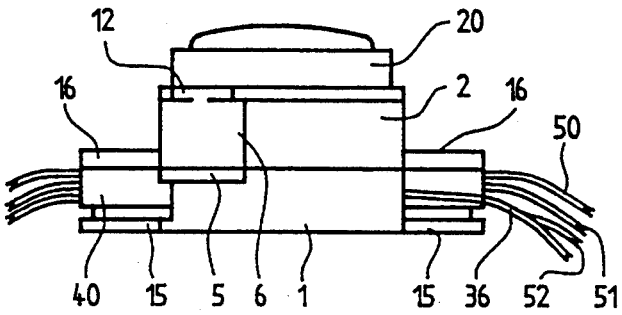
FIG. 5 is a side view of the pushbutton electrical switch assembly at a 1:1 ratio.
Figure 6:
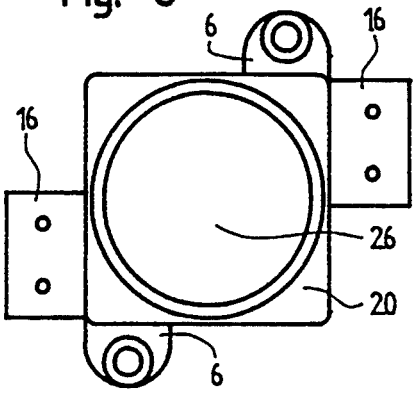
FIG. 6 is a top plan view of the pushbutton electrical switch assembly of FIG. 1, with a rounded pushbutton.
Figure 7:
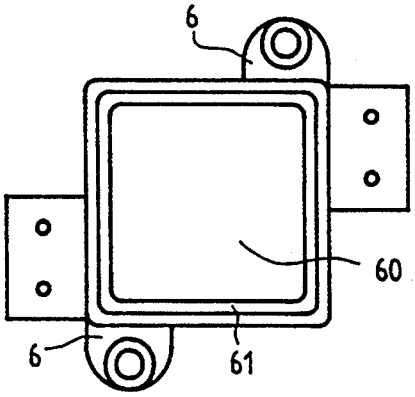
FIG. 7 is a top plan view of the pushbutton electrical switch assembly of FIG. 1, with a square pushbutton.

As shown in FIGS. 5, 6 and 7, in place of round pushbutton 26 and its associated housing cover 20, a quadrate or square pushbutton 26 and a properly fitting housing cover 61, can be utilized.

Figure 8:
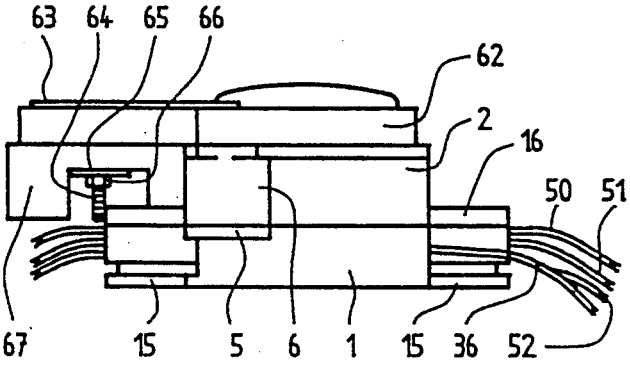
FIG. 8 is a side view of the pushbutton electrical switch assembly at a 1:1 ratio, having a legend plate.
Figure 9:
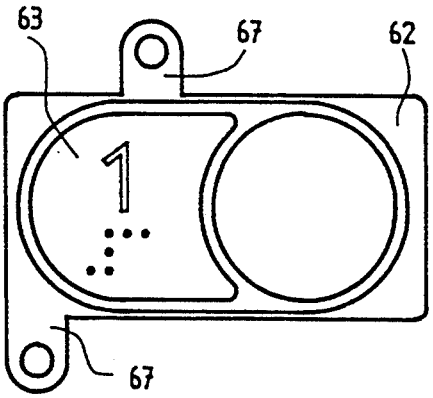
FIG. 9 is a top plan view of a housing cover of the pushbutton electrical switch assembly of FIG. 8 having a round pushbutton and a legend plate.

As shown in FIGS. 8 and 9, a laterally extended housing cover 62 is utilized, which is suitable for a round pushbutton and which includes an essentially half round legend or indicia plate 63, as shown in FIG. 9. Legend plate 63 is received in a recess of housing cover 62 and is bolted to housing cover via a threaded bolt 64 welded to legend plate 63, a washer 65 and a nut 66.

Figure 10:
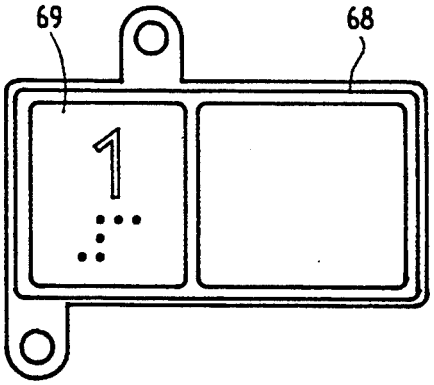
FIG. 10 is a top plan view of a housing cover of the pushbutton electrical switch assembly of FIG. 8 having a square pushbutton and a legend plate.

Numeral 67 designates the bosses for the additional attachment of housing cover 62, for example, at an elevator indicator board, wherein legend plate 63 carries the floor number in normal letters and in braille. In place of housing cover 62, as per FIG. 9, a similarly constructed housing cover 68 can be utilized for a square pushbutton and a square legend plate 69, as shown in FIG. 10, can also be utilized.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A pushbutton electrical switch assembly comprising:

a multipart housing including lower and upper housing portions having opposed flanges, said housing including a slidably retained pushbutton;

a lighting system;

an actuation member acting in one direction;

biasing means acting in a direction opposite to said actuation member;

switching members, including switching elements, wherein, via the actuation of said pushbutton, said actuation member is displaced against said biasing means and acts upon said switching members;

said lighting system including a plurality of light diodes and a printed circuit, said light diodes being arranged substantially squarely on said printed circuit;

said switching members and said lighting system being arranged adjacent to each other and transversely to the direction of displacement of said pushbutton;

said switching members being mounted in a position in which the directions of movement of said actuation member and the direction of movement of said switching elements of said microswitches are perpendicular to each other; and said printed circuit and said switching members being fitted, in a sandwich-type manner, between said opposed flanges.

2. The pushbutton electrical switch assembly of claim 1, wherein:

said lower and upper housing portions are interconnected without screws;

said lower and upper housing portions are square in shape and of the same size;

each of said housing portions having two bosses which in turn have apertures;

said bosses being arranged at diagonally opposed corners of said housing portions and being superimposed over one another;

each boss of said lower housing portion including a pipe-shaped projection, with each projection having a bevelled shoulder and slots at a distal end thereof;

the apertures of said bosses of said upper housing portion being adapted to receive said pipe-shaped projections and include a counterbore at each upper end thereof; and said bevelled shoulders being adapted to snap-fit into said counterbores during an assembly of said lower and upper housing portions.

3. The pushbutton electrical switch assembly of claim 1, wherein said light generated by said diodes has a cone of about 90 degrees.

4. The pushbutton electrical switch assembly of claim 1, wherein said printed circuit includes a bridge rectifier for supplying electric current to said light diodes.

5. The pushbutton electrical switch assembly of claim 1, wherein said switching members are microswitches.

6. The pushbutton electrical switch assembly of claim 1, wherein:

said actuation member comprises a substantially square plate, said plate being supported, relative to a bottom of the lower housing portion, by said biasing means;

said actuation member including switching cams, with said switching cams actuating said switching members; and said biasing means comprising four compression springs, with said compression springs being arranged at the corners of said lower and upper housing portions.

7. The pushbutton electrical switch assembly of claim 6, wherein:

said actuation member includes hook members, said hook members, via the action of said compression springs, abutting projections on said upper housing portion, thereby determining a boundary position of said actuation member; and said actuation member including slits, said slits being open on one side, with said slits serving for the reception of foot portions of said pushbutton.

8. The pushbutton electrical switch assembly of claim 1, wherein said actuation member comprises a substantially square plate, said plate being supported, relative to a bottom of the lower housing portion, by said biasing means.

9. The pushbutton electrical switch assembly of claim 8, wherein said actuation member includes switching cams, with said switching cams actuating said switching members.

10. The pushbutton electrical switch assembly of claim 8, wherein said actuation member includes hook members, said hook members, via the action of said biasing means, abutting projections on said upper housing portion, thereby determining a boundary position of said actuation member.

11. The pushbutton electrical switch assembly of claim 8, wherein said actuation member includes slits, said slits being open on one side, with said slits serving for the reception of foot portions of said pushbutton.

12. The pushbutton electrical switch assembly of claim 8, wherein said biasing means comprises four compression springs, with said compression springs being arranged at the corners of said lower and upper housing portions.

13. A pushbutton electrical switch assembly having: a housing including a lower and an upper housing portion having opposed flanges, said assembly comprising, within said housing:

a slidably retained pushbutton;

a lighting system;

an actuation member acting in one direction;

biasing means acting in a direction opposite to said actuation member;

switching members, including switching elements, wherein, via the actuation of said pushbutton, said actuation member is displaced against said biasing means and acts upon said switching members;

said lighting system including a plurality of light diodes and a printed circuit, said light diodes being arranged in a predetermined manner on said printed circuit;

said switching members and said lighting system being arranged adjacent to each other and transversely to the direction of displacement of said pushbutton;

said switching members being mounted in a position in which the directions of movement of said actuation member and the direction of movement of said switching elements of said microswitches are perpendicular to each other; and said printed circuit and said switching members being fitted, in a sandwich-type manner, between said opposed flanges.

14. The pushbutton electrical switch assembly of claim 13, wherein:

said lower and upper housing portions are interconnected without screws;

said lower and upper housing portions are substantially square in shape and of substantially the same size;

each of said housing portions includes two bosses, with said bosses having apertures;

said bosses being arranged at diagonally opposed corners of said housing portions and overlapping each other;

said bosses of said lower housing portion each including a pipe-shaped projection, with each of said projections having a bevelled shoulder and slots at a distal end thereof;

the apertures of said bosses of said upper housing portion being adapted to receive said pipe-shaped projections and including a counterbore at each upper end thereof; and said bevelled shoulders being adapted to snap-fit into said counterbores during an assembly of said lower and upper housing portions.

15. The pushbutton electrical switch assembly of claim 13, wherein:

said light generated by said diodes has a cone of about 90 degrees; and said light diodes are arranged in a quadrate form.

16. The pushbutton electrical switch assembly of claim 13, wherein said printed circuit includes a bridge rectifier for supplying direct electric current to said light diodes.

17. The pushbutton electrical switch assembly of claim 13, wherein said switching members are microswitches.

* * * * *